United States Patent [19]

Roberts et al.

[11] 4,368,717

[45] Jan. 18, 1983

[54] AUTOMATIC SHUT-OFF CIRCUIT FOR ELECTRONIC IGNITION SYSTEM

[75] Inventors: William J. Roberts, Toledo, Ohio; Gerald M. Owen, Hartselle, Ala.

[73] Assignee: Eltra Corporation, Toledo, Ohio

[21] Appl. No.: 175,978

[22] Filed: Aug. 7, 1980

[51] Int. Cl.[3] ..... F02P 11/00

[52] U.S. Cl. ..... 123/632; 123/146.5 D; 123/644

[58] Field of Search ..... 123/146.5 D, 609, 610, 123/611, 644, 632

[56] References Cited

U.S. PATENT DOCUMENTS

| | | | |
|---|---|---|---|
| 3,884,208 | 5/1975 | Beuter | 123/644 |
| 3,924,595 | 12/1975 | Brungsberg | 123/632 |
| 3,937,193 | 2/1976 | Kim | 123/632 X |
| 4,275,701 | 6/1981 | Arguello et al. | 123/609 |

*Primary Examiner*—Tony M. Argenbright
*Attorney, Agent, or Firm*—James P. DeClercq

[57] ABSTRACT

An electronic ignition system having an automatic shut-down feature is disclosed. In a first embodiment of the invention, should an output terminal of an integrated circuit (10, 10*a*) remain in a high voltage condition for a prolonged period of time, a capacitor (C100) which is charged from a constant voltage and alternately discharged through a terminal (105) of the integrated circuit, is allowed to charge, and gradually reaches the threshold voltage of a transistor (Q200) which is connected to shunting transistor (Q1), which diverts current from transistor (Q2) in series with an ignition coil primary winding (76, 76*a*) and gradually deenergizes the ignition system. In a second embodiment, a capacitor (C200) is charged from a constant voltage, and alternately discharged by being shorted by an inverting transistor (Q300) connected to a terminal (205) of an integrated circuit (200, 200*a*), which provides a signal which is the compliment of an output terminal. Thus, an ignition system according to the invention remains energized for a short period of time following the accidental or intentional stopping of an engine, and then is gradually deenergized, without producing a spark which may cause the engine to unexpectedly start.

1 Claim, 6 Drawing Figures

AUTOMATIC SHUT-OFF CIRCUIT FOR ELECTRONIC IGNITION SYSTEM

BACKGROUND OF THE INVENTION

This application relates to the field of automotive ignition systems. In particular, this application relates to an automatic shut-off circuit for an electronic ignition system.

There have been numerous attempts to provide devices to disable various automotive systems, including automotive ignition system, when the engine is not operating.

U.S. Pat. No. 1,878,313, issued to Pescara on Sept. 20, 1932, entitled "SAFETY CONTACT DEVICE FOR AUTOMOBILES", discloses a switch activated by oil pressure which opens when engine oil pressure drops.

U.S. Pat. No. 1,921,974, issued to Jolivet et al. on Aug. 8, 1933, entitled "SECURITY DEVICE FOR BATTERY IGNITION CIRCUITS", discloses the use of the time constant of a relay coil connected across breaker points of an ignition system, to either open the ignition circuit, or insert a current-limiting resistor in the ignition circuit if the breaker points have been open for a period of time.

U.S. Pat. No. 2,317,588, issued to Claytor et al. on Apr. 27, 1943, entitled "IGNITION SYSTEM", discloses the use of a bimetallic switch which opens in response to an electrical heater in series with automotive breaker points, which becomes hot when the points are closed for an excessive period of time, and causes the bimetallic switch to open and remove holding current from the coil of a relay switch.

U.S. Pat. No. 2,502,580, issued to McMillan on Apr. 4, 1950, entitled "ELECTRICAL CIRCUITS FOR MOTOR VEHICLES", discloses various circuits for disabling various automotive accessories, including the use of a relay switch which is closed by a starter switch and remains closed thereafter until the ignition switch is opened or various other conditions occur.

U.S. Pat. No. 2,790,841, issued to Sekul et al. on Apr. 30, 1957, entitled "PROTECTIVE ELECTRICAL SWITCHING SYSTEM", discloses the use of a time delay switch to disconnect a primary source of electric power from vehicle accessories after the ignition system has been deenergized.

U.S. Pat. No. 2,857,899, issued to Lardi on Oct. 28, 1958, entitled "AUTOMATIC IGNITION SHUT-OFF SWITCH", discloses the use of a combination of vacuum switch and solenoid switch to maintain operation of an automotive ignition system in response to generator output voltage or manifold vacuum.

U.S. Pat. No. 2,888,507, issued to Whitlow on May 26, 1959, entitled "AUTOMATIC SAFETY DEVICE FOR VEHICLES", discloses a structure for a time delay switch which is normally actuated to provide power to an ignition system by the ignition switch, and normally deactivated by a door switch.

U.S. Pat. No. 3,745,985, issued to Hohne on July 17, 1973 entitled "ARRANGEMENT FOR PREVENTING CURRENT FLOW IN THE IGNITION COIL OF AN INTERNAL COMBUSTION ENGINE DURING STANDSTILL CONDITIONS", discloses a circuit which differentiates pulses received from a magnetic pick up or breaker point to periodically discharge a capacitor. When the capacitor is no longer being discharged, the same switch which is opened to provide an ignition spark is opened to prevent current flow in the ignition coil.

U.S. Pat. No. 4,088,106, issued to Borst et al. on May 9, 1978, entitled "QUIESCENT CURRENT DISCONNECT SYSTEM AND APPARATUS FOR IGNITION COILS OF INTERNAL COMBUSTION ENGINE IGNITION SYSTEM", discloses the use of a digital logic circuit comparing a clock signal with a signal derived from a star-wheel transducer having three degree resolution, and disconnecting the ignition circuit when a counter circuit reaches a predetermined number before the next signal from the star-wheel transducer.

U.S. Pat. No. 4,106,460, issued to Kopera on Aug. 15, 1978, entitled "HALL EFFECT ELECTRONIC IGNITION CONTROL UNIT WITH AUTOMATIC SHUT-DOWN TIMER", discloses an ignition circuit having a capacitor which is charged when a first transistor is deenergized to provide a firing signal, and is discharged through a fixed signal, and is discharged through a fixed resistor. If the time between ignition impulses is too long, the voltage on the capacitor reaches the threshold of a programmable unijunction transistor, which shorts the base of the first transistor, deenergizing an ignition coil.

It is desirable to have an ignition circuit that will both remain energized for a sufficient time after the engine is stopped to provide an opportunity for making measurements for the purpose of testing and repair, and also disconnects the ignition coil, to prevent discharge of a storage battery, and over heating of the ignition coil and other components, without suddenly disconnecting the ignition coil so as to generate a spark. Generation of a single spark has been found sufficient to unexpectedly start a vehicle engine, causing damage and personel injury.

SUMMARY OF THE INVENTION

It is a primary object of the invention to provide a device for shutting off an ignition system when an engine is not operating. It is a feature of the invention that the ignition system is shut off by slowly decreasing the amount of current flowing through the primary of an ignition coil. It is an advantage of the invention that the ignition system is shut off without the possibility of inducing an ignition impulse causing a spark, and it is a further advantage of the invention that an ignition system remains operative for a sufficient time for making measurements of its operation for purposes of inspection or repair.

An ignition system is provided which is sensitive to the position of rotating element of an internal combustion engine, for producing a switched current in the primary of an ignition coil, for inducing an ignition impulse in the secondary of the ignition coil. A current limiting circuit is provided for controlling the amount of current through the ignition coil as voltage available to the ignition system varies in operation of a vehicle. A shut-off circuit is provided which is responsive to sustained current through the primary of the ignition coil, to cause the current limiting circuit to gradually limit the current through the ignition coil primary to zero.

DETAIL DESCRIPTION OF THE INVENTION

Figure 1:
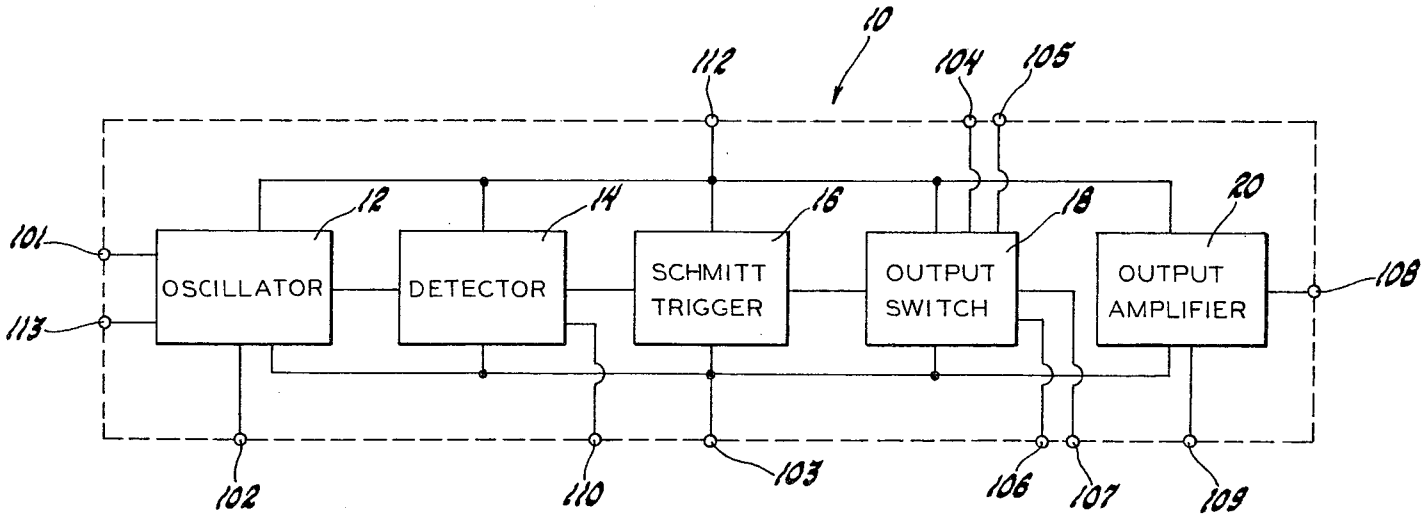
FIG. 1 is a block diagram of first circuit usable in a first embodiment of the invention.
Figure 2:
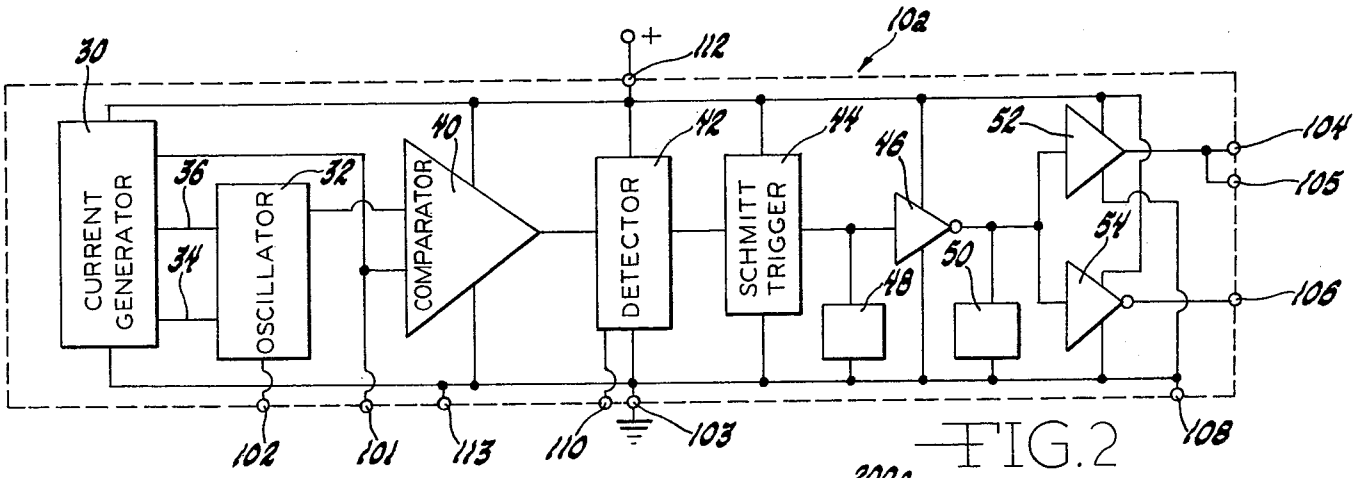
FIG. 2 is a block diagram of a second circuit usable in the first embodiment of the invention.
Figure 4:
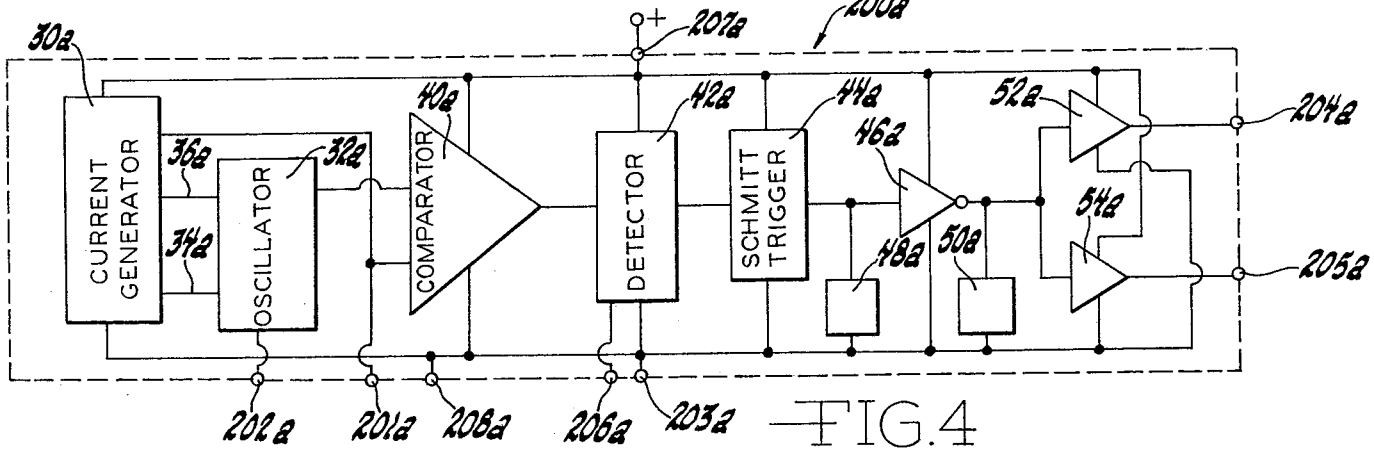
FIG. 4 is a block diagram of a second circuit usable in the second embodiment of the invention.

Referring to FIG. 1, a block diagram of a circuit usable in the invention is shown. It should be noted that FIGS. 1, 2, 3 and 4 are similar, FIGS. 2 and 4 showing a circuit with fewer connections, and FIGS. 1 and 2, and 3 and 4 showing alternate circuit concepts usable in the invention.

In FIG. 1, a circuit 10 is shown having an oscillator 12 connected to a detector 14. Detector 14 is connected to s Schmitt trigger 16, which is connected to an output switch 18. An output amplifier 20 is provided, and is connectable to output switch 18. It should be noted that this circuit provides an ignition control signal responsive to the position of a rotating engine element, and that numerous other circuits are usable. Among such alternate circuits and devices are Hall-effect sensors, optical electric sensors, inductive and capacitive sensor driving Wheatstone-type bridge circuits and various types of threshold circuits.

In the circuit shown in FIG. 1, terminals 101 and 113 are connected to oscillator 12 of circuit 10, for the purpose of connecting a feedback resistor, not shown, to oscillator 12. A terminal 102 of circuit 10 is provided for connecting a sensor coil, not shown, to oscillator 12. In a preferred embodiment, oscillator 12 produces an oscillation having a magnitude responsive to a rotating conductive member of an engine, which is rectified by detector 14. A terminal 110 of circuit 10 is connected to detector 14, for connecting a filter capacitor, not shown, to detector 14. A hysteresis device such as Schmitt trigger 16 is connected to detector 14, for providing a stepwise ignition control signal responsive to the position of a rotating portion of an engine to output switch 18. Terminals 104 and 105 of circuit 10 are connected to output switch 18, and provide similar output signals from output switch 18. Terminals 106 and 107 of circuit 10 are also connected to output switch 18, and provide output ingition control signals inverted from those provided at terminal 104 and 105. Terminal 109 is an input to output amplifier 20, and may be connected to an output of output switch 18, by connecting terminal 109 to terminal 104, 105, 106, or 107. Terminal 108 is connected to output amplifier 20, and provides an output ignition control signal from output amplifier 20. Electrical power may be provided to oscillator 12, detector 14, Schmitt trigger 16, output switch 18, and output amplifier 20 by external connection to terminal 112, an electrical return path being provided by an external connection to terminal 103.

Circuit 10 may be accomplished in accordance with the teaching of U.S. Pat. No. 3,473,110, issued to Hardin et al. on Oct. 14, 1969, and others, and may also be accomplished by use of an integrated circuit available from RCA Solid State Division, Somerville, N.J., U.S.A., under part No. TA6424 or TA6922.

FIG. 2 illustrates an alternate circuit 10*a*, which may be directly substituted for circuit 10 in the disclosed embodiments of the invention. Therefore, identical numbers will be used for the terminals of circuits 10 and 10*a*, even though their may be some difference in the precise function of the terminals. The only relevant functional difference between circuits 10 and 10*a* is that terminal 108 of circuit 10*a* is at a ground potential at all times, rather than being at a ground potential only when an ignition system according to the invention utilizing such a circuit is energized.

Circuit 10*a* includes a current generator 30, which provides an operating current and a bias current to oscillator 32 through lines 34 and 36. As in FIG. 1, terminal 102 is used to connect a sensor coil or the like of oscillator 32. Current generator 30 also provides a reference current through line 38 to terminal 101, for connection to an external resistor, not shown, connected between terminals 101 and 113, which serves circuits 10*a* as a reference resistor, rather than as a feedback resistor in equivalent circuit 10. A comparator 40 compares the constant voltage across the reference resistor with the output of oscillator 32, and provides an output to a detector 42. Detector 42, like detector 14 shown in FIG. 1, is connected to a terminal 110, for connection of a filter capacitor or the like. The output of detector 42 is applied to a Schmitt trigger 44, or an equivalent hysteresis device, for providing signal which is stepwise responsive to the output of oscillator 32. The output of Schmitt trigger 44 is amplified and inverted by inverter 46, and shaped by shaping circuits 48 and 50 connected to the input and output of inverter 46. In a preferred embodiment, shaping circuits 48 and 50 act upon the falling edge of the output from Schmitt trigger 44, to control the turn-off characteristics of an external switching device, and may be accomplished with a diode-resistor-capacitor circuit or its equivalent in solid state devices. The output of inverter 46 is applied to non-inverting amplifier 52, and to inverting amplifier 54, for providing output signals at terminals 104, 105, 106.

Circuit 10*a* may be accomplished by one skilled in the art in accordance with FIG. 2, or may be accomplished by the use of an integrated circuit available from Motorola Semiconductor Products, Inc. of Phoenix, Ariz., U.S.A. under part No. SC8789P2.

Figure 3:
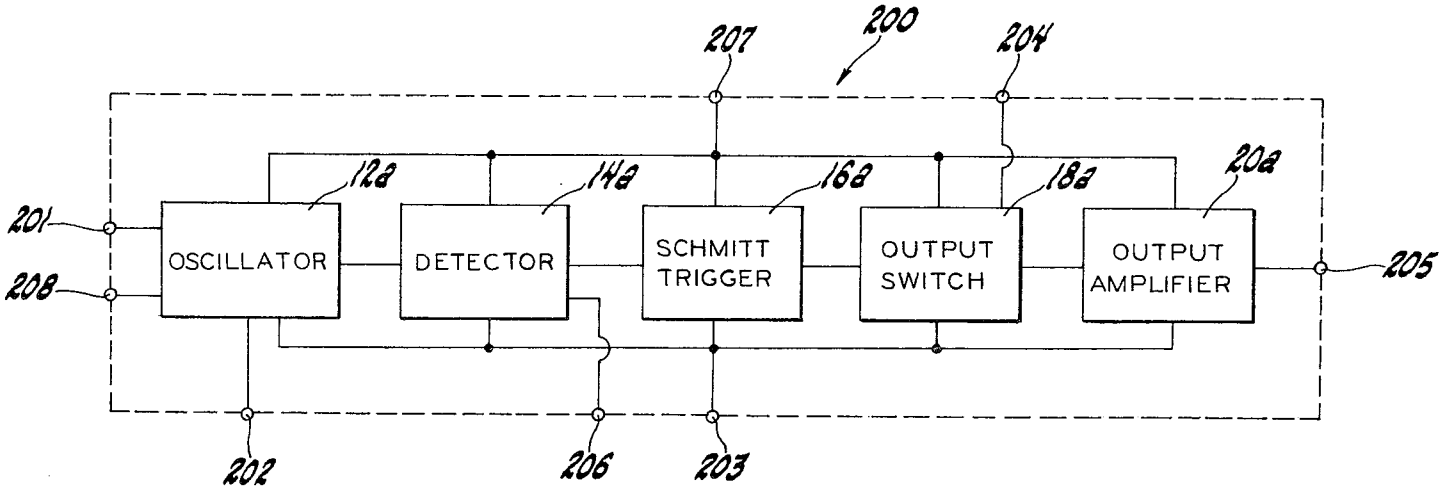
FIG. 3 is a block diagram of a circuit usable with second embodiment of the invention.

FIGS. 3 and 4 illustrate simplified versions of the circuits shown in FIGS. 1 and 2, respectively, which are functionally equivalent as used in the disclosed embodiments of the invention, but which do not provide a feature, shown in FIG. 5, below, which is not absolutely necessary for an ignition system emboding the invention. FIG. 3 shows a circuit 200, which contains an oscillator 12*a*, detector 14*a*, Schmitt trigger 16*a*, output switch 18*a* and output amplifier 20*a*, equivalent to devices 12, 14, 16, 18 and 20 shown in FIG. 1. Terminals 201, 202, 203, 204, 205, 206, 207 and 208 are functionally equivalent to terminals 101, 102, 103, 104, 108, 110, 112, and 113, respectively. It should be noted that, in FIG. 3, output switch 18*a* and output amplifier 20*a* need not be separate circuits, since no components need be interposed between output switch 18*a* and output amplifier 20*a*. An integrated circuit constructed in accordance with FIG. 3 is available from RCA Solid State Division, Somerville, N.J., part No. TA10180.

FIG. 4 shows a circuit 200*a* which is a simplified version of circuit 10*a* as shown in FIG. 2, and which is functionally equivalent in the disclosed embodiment of the invention to circuit 200 shown in FIG. 2. Circuit 200*a* includes a current generator 30*a*, an oscillator 32*a*, lines 34*a*, 36*a*, and 38*a*, a comparator 40*a*, a detector 42*a*, a Schmitt trigger 44*a*, an inverter 46*a*, shaping circuits 48*a* and 50*a*, non-inverting amplifier 52*a* and inverting amplifier 54*a*, the suffix "a" indicating that these components appear in circuit 200*a*. Circuit 200*a* is provided with terminals 201*a*, 202*a*, 203*a*, 204*a*, 205*a*, 206*a*, 207*a*, and 208*a* which are equivalent in function to terminals 201, 202, 203, 204, 205, 206, 207 and 208, respectively as used in the embodiment of the invention disclosed in FIG. 2. An integrated circuit in accordance with FIG. 4 is available from Motorda Semiconductor Products, Phoenix, Ariz. as part No. SC8789P1.

Figure 5:
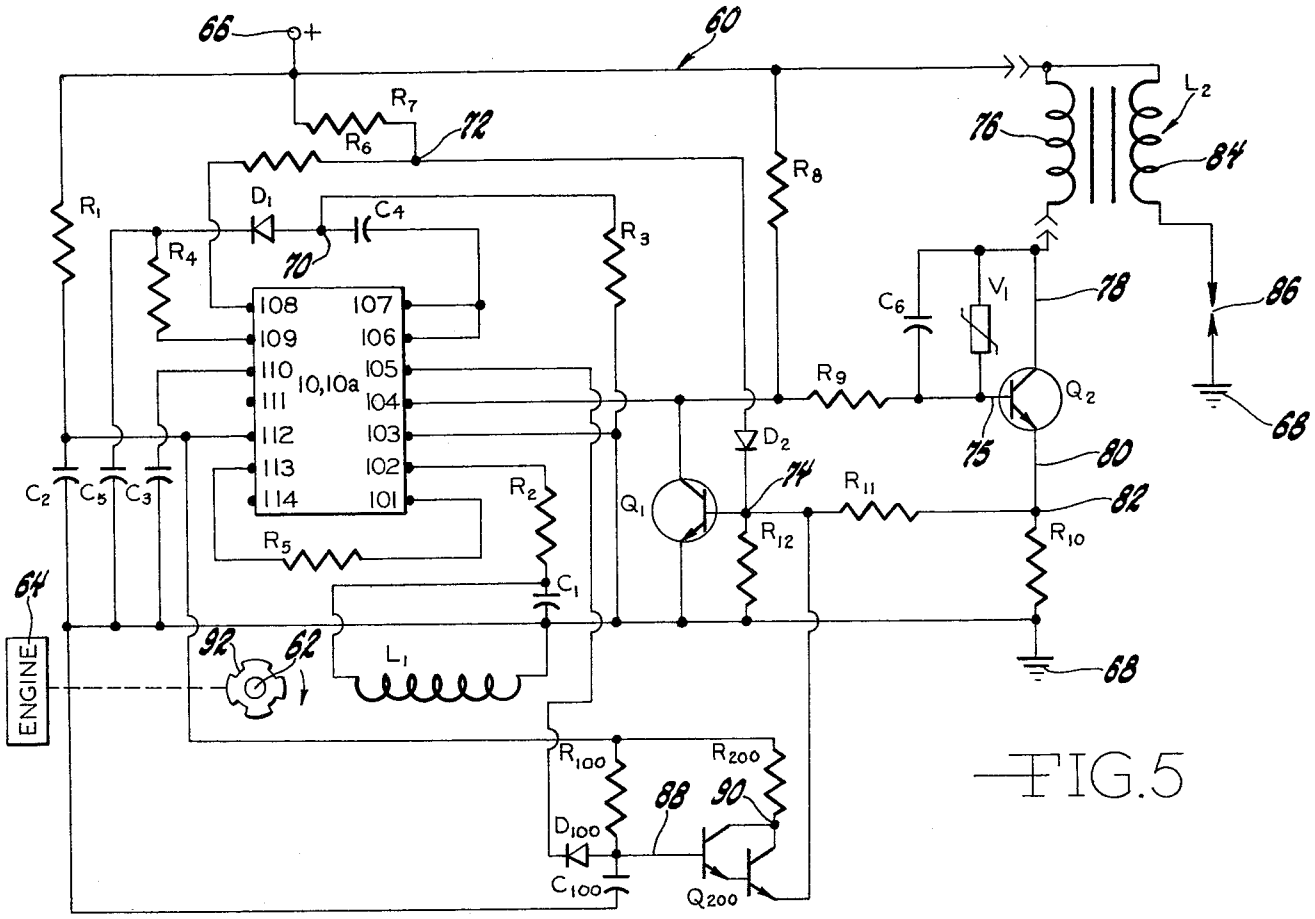
FIG. 5 is a schematic circuit diagram of a first preferred embodiment of the invention.

Referring now to FIG. 5, there is illustrated an ignition system 60 including a circuit 10 or 10*a* which is responsive to the position of a rotatable conductive member 62 of engine 64. Power is supplied to ignition system 60 between a positive terminal 66 and a ground 68. A resistor R1 is connected between terminal 66 and terminal 112 of circuit 10 or 10*a*. A resistor connects terminal 102 of circuit 10 or 10*a* to an oscillator tank circuit composed of the parallel combination of capacitor C1 and sensing coil L1, the tank circuit composed of capacitor C1 and sensing coil L1 being connected between resistor R2 and ground 68. A capacitor C2 is connected between terminal 112 of circuit 10 or 10*a* and ground 68, and a capacitor C3 is connected between terminal 110 of circuit 10 or 10*a* and ground 68. Terminal 103 of circuit 10 or 10*a* is connected to ground 68. Terminals 106 and 107 of circuit 10 or 10*a* are connected to terminal 103 of circuit 10 or 10*a* and to ground 68 through a series combination of capacitor C4 and resistor R3, a junction 70 of resistor R3 and capacitor C4 being connected to the anode of a diode D1. The cathode of diode D1 is connected to terminal 109 of circuit 10 or 10*a* through a resistor R4, and to ground 68 through a capacitor C5. A resistor R5 is connected between terminals 101 and 113 of circuit 10 or 10*a*. Positive terminal 66 is connected to terminal 108 of circuit 10 or 10*a* through a series combination of resistors R6 and R7, the junction 72 being connected to the anode of a diode D2. The cathode of diode D2 is connected to base lead 74 of shunting means shown as transistor Q1. A resistor R8 is connected between positive terminal 66 and terminal 104 of circuit 10 or 10*a*. A resistor R9 is connected between terminal 104 of circuit 10 or 10*a* and base lead 75 of transistor Q2. The collector of transistor Q1 is connected to terminal 104 of circuit 10 or 10*a*, and the emitter of transistor Q1 is connected to ground 68. Primary winding 76 of ignition coil L2 is connected between positive terminal 66 and collector lead 78 of transistor Q2. Emitter lead 80 of transistor Q2 is connected to ground 68 through resistor R10. A resistor R11 is connected between a junction 82, joining resistor R10 and emitter lead 80 of transistor Q2, and base lead 74 of transistor Q1. A resistor R12 is connected between base lead 74 of transistor Q1 and ground 68. Secondary winding 84 is ignition coil L2 is connected between positive terminal 66 and ground 36 through a spark gap 86. As will be apparent, a plurality of spark gaps 86 may be provided, and selected by a conventional distributor, not shown, interposed between ignition coil L2 and spark gaps 86.

An ignition shut-off timing circuit is shown as including resistors R100 and R200, a timing means such as capacitor C100, a diode D100 and a transistor Q200. Transistor Q200 is shown as a Darlington transistor. Capacitor C100 is connected between ground 68 and base lead 88 of transistor Q200. Transistor Q200 has a collector lead 90 connected to terminal 112 of circuit 10 or 10*a* through a resistor R200. It should be noted that resistor R200 is desirable but not necessary to practice the invention. Base lead 80 of transistor Q200 is connected to terminal 112 of circuit 10 or 10*a* through resistor R100, and connected to terminal 105 of circuit 10 or 10*a* through diode D100. The anode of diode D100 is connected to base lead 88, and the cathode is connected to terminal 105 of circuit 10 or 10*a*.

As will be apparent from FIG. 5, power is supplied to circuit 10 or 10*a* through resistor R1, capacitor C2 serving as filter capacitor. As engine 64 causes member 62 to rotate, the proximity of outermost surface 92 to sensor coil L1 will vary, thus varying the Q of sensor coil L1, with proximity causing a decrease in Q, and a decrease in the amplitude of oscillation, of oscillation 12 of circuit 10 or 10*a*, by increasing the losses of the tank circuit formed by coil L1 and capacitor C1. Resistor R2 serves as a protective resistor, since it may be possible in an embodiment of the invention used with a distributor for a spark to jump from a distributor rotor to sensor coil L1, R2 limiting current to protect circuit 10. When the Q of sensor coil L1 is decreased, the amplitude of oscillation of oscillator 12 of circuit 10 will decrease to a value determined in part by the value of feedback resistor D5. Detector 14 and Schmitt trigger 16, of circuit 10, or comparator 40, detector 42 and Schmitt trigger 44 of circuit 10*a* convert the slowly-varying amplitude of oscillation of oscillator 12 to a stepwise function of the proximity of surface 92 and sensor coil L. In the circuit illustrated, ignition control signal terminals 104 and 105 change from a high voltage level to a low voltage level when surface 92 departs from sensor coil L1, and ignition control signal terminal 106, and 107 of circuit 10, change from an low voltage level to a high voltage level when surface 92 departs from the proximity of sensing coil L1. As will be apparent, inverse changes of ignition control signal terminals 104, 105, 106 and 107 will occur when surface 92 approaches L1. However, in the illustrated embodiment, a spark is produced when surface 92 moves away from sensor Ll. Obviously, the illustrated circuit could be easily modified to produce a spark when surface 92 approached sensing coil L1. As illustrated, terminal 104 is in a high voltage state while surface 92 is in proximity to sensing coil L1. This energizes base lead 75 of transistor Q2, to place transistor Q2 in a conductive state and allow current to flow through primary winding 76 of ignition coil L2. As surface 92 of rotating member 62 leaves the proximity of sensing coil L1, terminal 104 will stepwise become a low voltage state, forcing transistor Q2 to a nonconductive state, blocking the current through primary winding 76 of ignition coil L2, and inducing an ignition impulse in secondary winding 84 of ignition coil L2, which causes a spark across spark gap 86. Resistor R8 serves as pull up resistor for terminal 104 of circuit 10 of 10*a*.

Under certain conditions, particularly when attempting to start an engine 64 provided with an ignition system 60 at extremely low temperatures, it is possible that terminal 104 will occasionally not remain in a low voltage state for a sufficiently long time. The circuit composed of capacitor C5, resistor R4, diode D1, capacitor C4, and resistor R3 is provided should an occasional failure to produce an ignition spark under certain circumstances be unacceptable.

This circuit also serves to prevent jitter, a slight variation in timing caused by negative transients due to ringing of the ignition coil L2 upon firing a spark gap such as spark gap 86, affecting an integrated circuit such as circuit 10.

When terminal 104 stepwise becomes a low voltage state, terminals 106 and 107 stepwise become a high voltage state, charging capacitor C4, which slowly decays through resistor R3. When capacitor C4 is charged, voltage appearing at junction 70 will cause a current through diode D1 to charge capacitor C5. The voltage across capacitor C5 is coupled to input terminal 109 of circuit 10 only, circuit 10*a* as illustrated not having an input terminal 109. Therefore, capacitors C4 and C5, diode D1, and resistors R3 and R4 could be eliminated from an embodiment of system 60 using circuit 10*a*. A high voltage state appearing at terminal 109, an input of output amplifier 20 of circuit 10, for a predetermined time causes terminal 108, an output of output amplifier 20 of circuit 10, to become a high voltage state for a predetermined period of time. The high voltage state appearing at terminal 108 is coupled to base lead 74 of transistor Q1 through resistor R6 and diode D2, causing transistor Q1 to become conductive, forcing terminal 104 to a low voltage state for a time long enough to produce an ignition impulse in secondary 84 of ignition coil L2, and preventing jitter.

It should be specifically noted that the circuit composed of capacitor C5, resistor R4, diode D1, capacitor C4 and resistor R3 is intended to prevent a condition which has been found not to be a serious problem. Therefore, in a preferred embodiment of the invention, capacitor C5, resistor R, diode D1, capacitor C4, and resistor R3 have been eliminated, terminals 106 and 107 being connected to terminal 109.

Resistor R7 is connected between positive terminal 66 and base lead 74 through resistor R7 and diode D2. This provides a protective circuit for ignition circuit 60 should the voltage at positive terminal 66 become undesirably high, such as when an engine accessory, not shown, is suddenly switched off. A high voltage appearing at positive terminal 66 will be coupled to base lead 74 of transistor Q1, causing transistor Q1 to become conductive, and forcing transistor Q2 to a nonconductive state, protecting transistor Q2 and ignition coil L2.

The capacitor C6 is shown connected between collector lead 78 and base lead 75 of transistor Q2. If desired, a voltage regulating means such as a voltage dependent resistor may be placed in parallel with capacitor C6 to limit the voltage differential between base lead 75 and collector lead 78 of transistor Q2.

Capacitor C6 serves to control the switching time of transistor Q2. As transistor Q2 is driven toward a nonconductive state, the voltage on collector lead 78 will increase, causing current to flow through capacitor C6, into base lead 75 of transistor Q2, causing transistor Q2 to switch at a controlled rate. Resistor R9 forces current through capacitor C6 to enter base lead 75 of transistor Q2, rather than to return to terminal 104 of circuit 10. Capacitor C6 also serves to prevent oscillation of transistor Q2, a condition which has been found to occur if a transistor Q2 having a very high gain is used in an embodiment of the invention subjected to a low ambient temperature.

A diode D2 is shown as having a cathode connected to base lead 75, and an anode connected to ground 68. As is known, if a lead wire connected to a spark gap such as spark gap 86 is disconnected, and extremely high voltage will be developed in secondary winding 84, and an extremely high negative transient will be coupled to primary winding 76. It has been determined that such a negative transient may flow through capacitor C6, resistor R9, and into termina 104 of circuit 10. As will be apparent, a negative transient applied to a semiconductor device such as may be associated with terminal 104 may cause it to change from a nonconductive to a conductive state, turning transistor Q2 back on after it has been turned off to create an ignition impulse. This phenomenon becomes significant when a wire connecting secondary winding 84 and spark gap 86 is not disconnected, but rather has an extremely high resistance so that there would be no discharge across spark gap 86, instead of a weak discharge. It has been found that diode D2 bypasses such negative transients to ground 68, and eliminates this potential problem.

Resistors R10, R11 and R12 form a current-limiting circuit for transistor Q2 and ignition coil L2. Current flowing through primary winding 76 of ignition coil 12 and transistor Q2 induces a voltage drop across resistor R10. Resistors R11 and R12 form a voltage divider, applying voltage appearing at junction 82 to base lead 74 of transistor Q1. Therefore, as higher current attempts to flow through resistor R10 when terminal 104 is in a high voltage state, and ignition system 60 is in a dwell state, transistor Q1 will become more conductive, bypassing current from base lead 75 of transistor Q2, causing transistor Q2 to become less conductive and limit the current. This circuit is intentionally made temperature sensitive, transistor Q2 being less sensitive when cold, and more sensitive when hot, resulting in greater current available to cause an ignition spark at low temperatures, and less current available, to protect ignition coil L2 and transistor Q3, at higher temperatures. Capacitor C100 is continuously charged from the voltage appearing at positive supply terminal 112 of circuit 10 or 10*a*, through resistor R100. Terminal 105 of circuit 10 or 10*a*, being in phase with, or connected to terminal 104 of circuits 10 or 10*a*, is in a high voltage state, blocking the discharge of capacitor C100 when transistor Q2 is driven towards a conductive state, and resets the timing means shown as capacitor C100 by allowing the discharge of capacitor C100 when transistor Q2 is driven toward a nonconductive state to cause an ignition impulse in secondary winding 84.

Should terminal 105 remain in a low voltage state for a prolonged period of time, no harm can be done, transistor Q2 being driven toward a nonconductive state, blocking the current flow through coil 76 and transistor Q2, ignition system 60 being effectively shut off, no possibility of a spark appearing at spark gap 86 existing. However, should terminal 105 remain in a high voltage state for prolonged period of time, indicative of current flowing through ignition coil L2 and transistor Q2, it is desirable to block the flow of current through ignition coil l2 and transistor Q2 without causing a spark at spark gap 86, but in a sufficiently long time to allow electrical measurement of the characteristics of ignition system 60.

When terminal 105 of circuit 10 or 10*a* is in a high voltage state, capacitor C100 charges through resistor R100. Should terminal 105 of circuit 10 remain in a high voltage state for a prolonged period of time, capacitor C100 will charge to a voltage sufficient to exceed the threshold caused by the voltage drops of the two base-emitter junctions of Darlington transistor Q200, and the base-emitter voltage drop of transistor Q1, and current will begin to flow into base 74 of Q1, driving shunting transistor Q1 towards its conductive state. As capacitor C100 continues to charge, greater current will flow into base lead 74 of transistor Q1, driving transistor Q1 further toward its conductive state. Transistor Q1 being conductive, the voltage at terminal 104 and base lead 75 of transistor Q2 will be lowered, driving transistor Q2 towards its nonconductive state, gradually blocking the current through primary winding 76 of ignition coil L2 and transistor Q2. In actual physical embodiments of the invention as illustrated in FIG. 5, the charging time of capacitor C100 allowed continued energization of an ignition system 60 for twenty to thirty seconds before transistor Q2 began to be driven toward its nonconductive state, transistor Q2 becoming nonconductive in an additional 10 seconds. In this manner, ignition system 60 is effectively shut off without any possibility of spark being generated that could, under some conditions, restart an engine with consequent damage and personal injuries.

Figure 6:
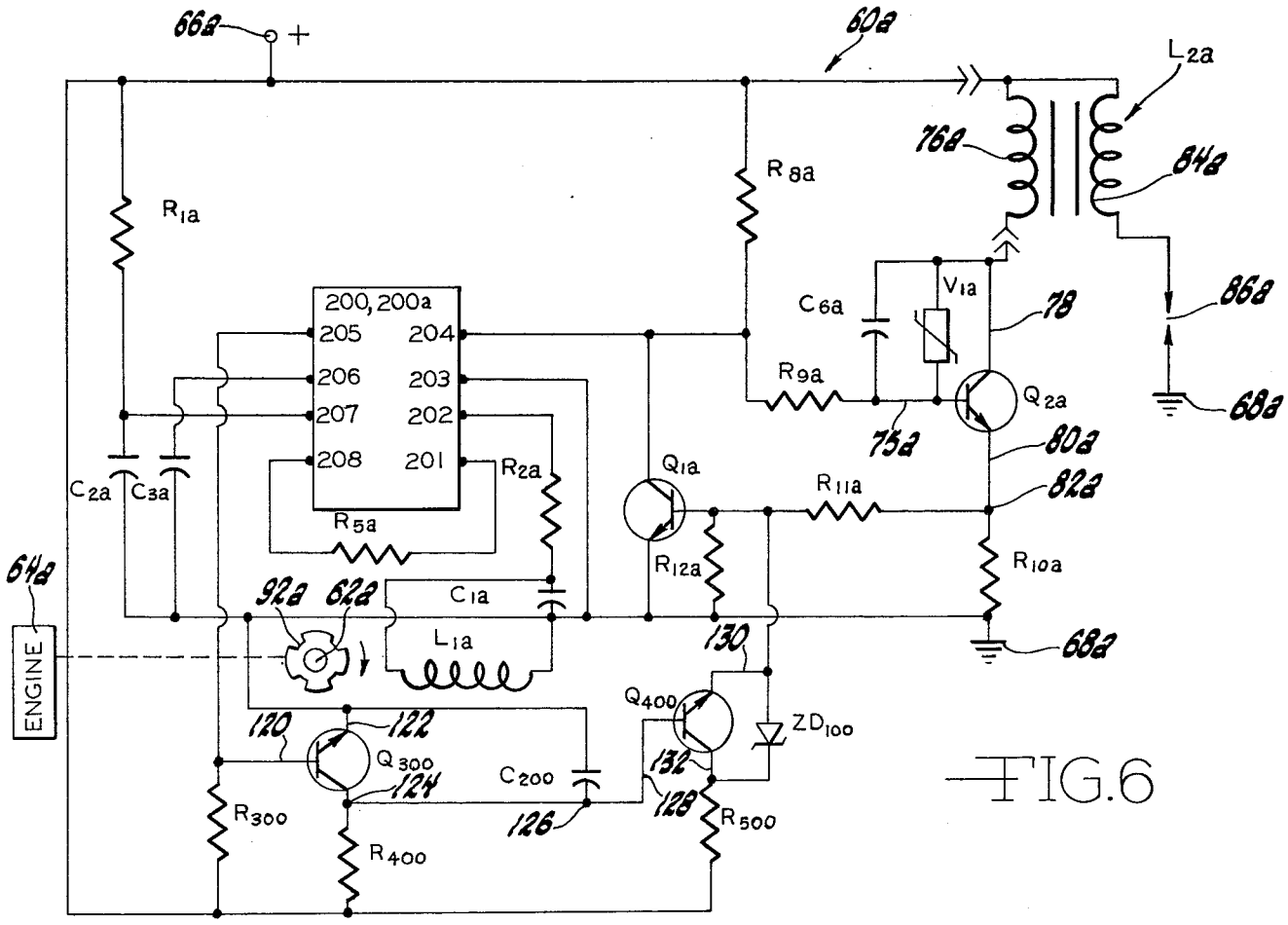
FIG. 6 is a schematic circuit diagram of a second preferred embodiment of the invention.

FIG. 6 illustrates an ignition system 60*a*, which is a simplified version of ignition system 60 shown in FIG. 5, without the gradually-effective over-voltage protection provided by resistors R6 and R7 and diode D2 in FIG. 5, and without the benefits of the circuit formed by resistor R3 and R4, capacitors C4 and C5, and diode D1. It will be obvious that gradually-effective over-voltage protection can be added to the embodiment illustrated in FIG. 6, instead of that provided by Zener diode ZD100.

All relevant component designations shown in FIG. 5 that perform the same or equivalent functions in FIG. 6 are given identical designations with a suffix a in FIG. 6. Power is supplied to ignition system 60*a* at positive terminal 66*a*, and is applied to terminal 207 of circuit 200 or 200*a* through resistor R1*a*. Capacitor C2*a* serves as filter capacitor connected between terminal 207 and ground 68*a*. Capacitor C3*a* is connected to terminal 206 of circuit 200 or 200*a*, and serves as a filter capacitor for detector 14*a* or 42*a*. A resistor R5 is connected between terminal 201 and 208, acting either as a feedback resistor for oscillator 12*a* or as a reference resistor for comparator 40*a*. Terminals 204 and 205 are complimentary outputs of circuit 200 or 200*a* which are indicative of the proximity of surface 92*a* to coil L1*a*. Terminal 203 is connected to ground 68, and terminal 202 is connected to a tank circuit composed of a parallel combination of coil L1*a* and capacitor C1*a*, in series with protective resistor R2*a*. As above, proximity of surface 92*a* of element 62*a* to sensor coil L1*a* causes the Q of coil L1*a* to decrease, decreasing the output of oscillator 12*a* or 32*a*, resulting in a signal indicative of this proximity at terminals 204 and 205. As illustrated, terminal 204 is in a high voltage state when surface 92*a* is close to sensing coil L1, and falls to a low voltage level when surface 92*a* recedes from sensing coil L1. In the illustrated embodiment, designed to fire a spark gap 86 when surface 92*a* recedes from sensing coil L1*a*, terminal 204 is in a high voltage state to allow current to flow through primary winding 76*a* for a dwell period, the voltage at terminal 204 being coupled to base lead 75*a* through resistor R9*a*, placing transistor Q2*a* in a conductive state. When surface 92*a* recedes from sensing coil L1*a*, terminal 104 assumes a low voltage state, forcing transistor Q2*a* to assume a nonconductive state, and blocking the flow of the current through primary winding 76*a*. The collapse of a flux field in coil L2*a* then causes a high voltage to be induced in secondary winding 84*a*, which causes a spark across the spark gap 86*a*.

Since resistor R10*a*, is connected between emitter lead 80*a* of transistor Q2*a* and ground 68*a*, the voltage at junction 82*a* is indicative of current through primary 76*a* and transistor Q2*a*. Resistors R11*a* and R12*a* form a voltage divider, applying a portion of this voltage to base lead 74*a* of transistor Q1*a*. As current through primary winding 76*a* and transistor Q2*a* attempts to increase, transistor Q1*a* will become more conductive, and partially or totally shunt terminal 204 or circuit 200 or 200*a*, causing transistor Q2*a* to become less conductive.

When terminal 204 is in a low voltage state, transistor Q2*a* becomes conductive, and also terminal 205 assumes a high-voltage state. According to the invention, a transistor Q300 has a base lead 120 connected to positive terminal 66*a*, through resistor R300, and to terminal 205, an emitter lead 122 connected to ground 68*a*, and a collector lead 124 connected to positive terminal 68*a* through resistor R400. Transistor Q300 will become conductive when terminal 205 is in a high voltage state, and will become nonconductive when terminal 205 is in a low voltage state. A capacitor C200 connected between ground 68*a* and collector lead 124, will be charged through resistor R400 when transistor Q300 is nonconductive, and will discharge through transistor Q300 when transistor Q300 is conductive. The terminal 126 of capacitor C200 connected to collector lead 124 of transistor Q300 and is also connected to base lead 128 of transistor Q400. Transistor Q400 has an emitter lead 130 connected to base lead 74*a* transistor Q1*a*, and a collector lead 132 collected to positive terminal 66*a* by resistor R500. A zener diode ZD100 is connected with its anode connected to a collector lead 130 and base lead 74*a*, its cathode connected to collector lead 132.

Should terminal 204 of circuit 200 or 200*a* assume a high voltage state for a prolonged period of time, allowing current to flow through primary winding 76*a* and transistor Q2*a* for a prolonged period of time, the resulting low voltage level at terminal 205 will cause transistor Q300 to become nonconductive, and capacitor C200 will begin to charge through resistor R400. As capacitor C200 charges, the voltage appearing at terminal 106 will eventually rise to the threshold voltage formed by the base-emitter voltage drops of transistors Q400 and Q1*a*, and transistor Q400 will begin to conduct, allowing current to flow into base lead 74*a* from positive terminal 68*a* through resistor R500, causing transistor Q1*a* to become conductive, and shunting some of the current from terminal 204 of circuit 200 or 200*a* to ground 68*a*, causing transistor Q2*a* to become less conductive. As capacitor C200 continues to charge, transistor Q1*a* becomes increasingly more conductive, and gradually causes transistor Q2*a* to assume a nonconductive state. In this manner, in an actual physical embodiment of the system illustrated in FIG. 6, ignition system operation was maintained for 20 to 30 seconds following the time an engine 64*a* was stopped with surface 92*a* of member 62*a* in close proximity to sensing coil L1, and then effectively deenergized over an approximate 10 second period without causing a spark across spark gap 86*a*.

It will be obvious to one skilled in the art that numerous modification and variations of the invention are possible, and may be made without departing from the spirit and scope of the invention.

We claim:

1. An electronic ignition system for use with an engine having a rotating member, including:

means for producing an ignition control signal in stepwise response to the position of said rotating member;

an ignition coil having a primary winding and a secondary coil magnetically coupled to said primary winding for causing an ignition impulse in response to a change in flux in said ignition coil, said flux being responsive to current through said primary winding;

means for supplying said current;

means for controlling said flow of current through said primary winding in response to said ignition control signal;

means for regulating said flow of current through said primary winding responsive at least in part to said flow of current;

automatic means for causing said means for regulating said flow of current to block said flow of current when said ignition control signal remains in a first predetermined state for a predetermined time;

said automatic means including timing means and threshold means;

said timing means being reset when said ignition control signal is in a second predetermined state;

said timing means producing a gradually increasing timing signal magnitude, said timing means becoming effective upon said means for regulating when the magnitude of said timing signal exceeds a threshold of said threshold means, said flow of current being blocked when said timing signal is effective upon said means for regulating for a second predetermined time;

said timing means being a capacitor;

said threshold means being a transistor having a control terminal electrically connected to said capacitor;

said system including means for resetting said timing means by discharging said capacitor;

said means for controlling including a first solid-state device connected in series with said primary winding;

said first solid-state device having a control terminal responsive to said ignition control signal;

said means for regulating including a second solid-state device shunting said control terminal;

said first solid-state device being a second transistor having controlled terminals connected directly electrically in series with said primary winding of said ignition coil, said control terminal being a base terminal of said second transistor;

said second solid-state device being a third transistor having a first controlled terminal directly connected to an electrical ground, and a second controlled terminal resistively connected to said base terminal of said second transistor, said third transistor including a base terminal directly connected to a controlled terminal of said threshold means.

* * * * *